US006204610B1

(12) United States Patent
Komiya

(10) Patent No.: US 6,204,610 B1
(45) Date of Patent: Mar. 20, 2001

(54) ELECTROLUMINESCENCE DISPLAY DEVICE

(75) Inventor: Naoaki Komiya, Ohgaki (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/528,157

(22) Filed: Mar. 17, 2000

(30) Foreign Application Priority Data

Mar. 18, 1999 (JP) ..... 11-73928

(51) Int. Cl.[7] ..... G09G 3/10

(52) U.S. Cl. ..... 315/169.3; 315/169.1; 315/224; 345/76; 345/77; 345/204; 345/214

(58) Field of Search ..... 315/169.3, 169.1, 315/167, 224, 291; 345/76, 77, 82, 92, 204, 211, 212, 214; 313/500, 505, 506; 362/800

(56) References Cited

U.S. PATENT DOCUMENTS 5,742,129 * 4/1998 Nagayama et al. ..... 315/167
5,745,085 * 4/1998 Tomio et al. ..... 345/63
5,828,181 * 10/1998 Okuda ..... 315/169.3
5,886,474 * 3/1999 Asai et al. ..... 315/169.1
5,990,629 * 11/1999 Yamada et al. ..... 315/169.3
6,028,573 * 2/2000 Orita et al. ..... 345/66
6,084,579 * 7/2000 Hirano ..... 345/205

* cited by examiner

*Primary Examiner*—Haissa Philogene
(74) *Attorney, Agent, or Firm*—Cantor Colburn LLP

(57) ABSTRACT

A drive circuit is provided in an active type electroluminescence (EL) display device including a plurality of EL elements (20). Each EL element is composed of a plurality of anodes (201) separately formed corresponding to each pixel, a cathode (202) commonly formed for the plurality of anodes, and an emissive layer (45) interposed between the anodes and the cathode. The EL elements are driven by TFTs 24 connected between the plurality of anodes provided for each pixel and a power source voltage (Vdd). The drive circuit comprises a current detector circuit (2) for detecting the current flowing from the cathode and for generating an output voltage corresponding to the detected current, a voltage inverting amplifier circuit (3) for inverting and amplifying the output voltage, and a current amplifier circuit (4) for performing current amplification of the output from the voltage inverting amplifier circuit. The drive circuit operates to increase or decrease the power source voltage (Vdd) in accordance with the current flowing from the cathode. With this arrangement, images having optimal contrast according to the number of light-emitting pixels can be displayed while power consumption is reduced.

9 Claims, 5 Drawing Sheets

ELECTROLUMINESCENCE DISPLAY DEVICE

BACKGROUND OF THE INVENTION

1. Field of the Invention

The present invention relates to an active type electroluminescence (EL) display device in which organic EL elements are driven using thin film transistors (TFT).

2. Description of the Related Art

Organic EL elements are suited for liquid crystal displays with reduced thickness because organic EL elements are self-emissive and therefore do not require a backlight. Furthermore, organic EL elements do not restrict the viewing angle of display devices in which they are employed. For these reasons, it is widely expected that organic EL displays will be as the primary display devices of the next generation.

Organic EL display devices are commonly classified as being either passive matrix type, having a simple matrix structure, or an active matrix type employing Thin Film Transistors (TFTs). In a conventional active matrix device, a drive circuit as shown in FIG. 1 is employed.

In FIG. 1, numeral 70 denotes an organic EL element. A drive circuit for one pixel comprises a switching TFT 71 which turns on and off according to a selection signal SCAN. In the TFT 71, a display signal DATA from a display signal line 75 is applied to the drain, while the selection signal SCAN from a selection signal line 76 is applied to the gate. The drive circuit also comprises a capacitor 72 connected between the source of the TFT 71 and a predetermined direct current voltage Vsc. When the TFT 71 is turned on, the capacitor 72 is charged with the display signal supplied from the display signal line 75. The capacitor 72 retains the charge voltage VG when the TFT 71 is turned off. The drive circuit further includes a driving TFT 74. In the TFT 74, the drain is connected to a power source line 77 that supplies a power source voltage Vdd, while the source is connected to the anode of the organic EL element 70. The retained voltage VG from the capacitor 72 is supplied to the gate of the TFT 74, which allows the TFT 74 to drive the organic EL element 70 by a current. The cathode of the organic EL element is typically connected to a ground (GND) potential. The power source voltage Vdd is a positive potential of, for example, 10V. The voltage Vsc may be the same potential as Vdd, or alternatively, a ground (GND) potential.

As shown in FIG. 2, the organic EL element 70 comprises an anode 51 constituted by a transparent electrode made of ITO (indium tin oxide) or a similar material, and a cathode 55 composed of a magnesium-indium alloy. Laminated between the anode 51 and the cathode 55 are, in order, a hole-transport layer 52 composed of MTDATA(4,4',4"-tris (3-methylphenylphenylamino)triphenylamine), an emissive layer 53 composed of TPD (N,N'-diphenyl-N, N'-di(3-methylphenyl)-1,1'-biphenyl-4,4'-diamine) and rubrene, and an electron transport layer 54 made of Alq3 (8-hydroxyquinoline aluminium). Light is emitted when a hole injected from the anode 51 and an electron injected from the cathode 55 recombine within the emissive layer 53. The light radiates outside through the side of the transparent anode 51, as indicated by an arrow in the figure.

The driving TFT 74 is configured by forming on a glass substrate 60, in order, a gate electrode 61; a gate insulating film 62; a poly-silicon thin film 65 including a drain region 63, a channel region, and a source region 64; an interlayer insulating film 66; and a planarization film 67. The drain region 63 is connected to a drain electrode 68 constituting the power source line 77 (see FIG. 1). The source region 64 is connected to the transparent electrode 51 serving as the anode of the organic EL element.

In a conventional arrangement, the cathode of the EL element is connected to the ground potential. The anode is connected to the TFT 74 for driving the EL element by current, and this TFT 74 is supplied with a fixed positive power source voltage Vdd. With such an arrangement, the maximum current flowing in one EL element is fixed, and the emissive luminance of the pixel is therefore also fixed.

When displaying an image in which light-emitting pixels dominate a large area in the overall display screen, if the luminance of the light-emitting pixels is too high, the displayed image may become glaring or bright, and unpleasant to the viewer's eyes. The above-mentioned power source voltage may therefore be lowered to set a lower maximum current value, such that the pixels emit light at a slightly reduced luminance. Under such a setting, the emissive luminance becomes similarly reduced when displaying an image in which light-emitting pixels cover only a small area of the overall display screen, producing a display image having a low contrast. However, if the power source voltage is set at a high level to allow the pixels to emit light at an increased luminance suitable for an image having a small area covered with light-emitting pixels, the display screen again becomes glaringly bright in the viewer's eyes when displaying an image having a large area dominated by light-emitting pixels. Furthermore, power consumption will be undesirably increased.

SUMMARY OF THE INVENTION

The object of the present invention is to provide a device for displaying images having suitable contrast according to the area covered by light-emitting pixels, namely, the number of light-emitting pixels.

To accomplish the above object, the present invention provides an electroluminescence display device having a plurality of pixels. Each pixel comprises an electroluminescence element including at least an emissive layer between an anode separately provided for each pixel and a cathode commonly provided for the plurality of pixels. Each pixel further comprises at least a switch element for controlling a current supply from a power source commonly provided for the plurality of pixels to the anodes of the electroluminescence elements. In this display device, a current flowing from the common cathode provided for the plurality of pixels is detected, and emissive luminance of the electroluminescence elements is controlled according to the detected current.

According to another aspect of the present invention, the display device comprises a current detector circuit for detecting current flowing from the common cathode provided for the plurality of pixels, and a control circuit for controlling the emissive luminance of the electroluminescence elements according to the detected current.

According to a further aspect of the present invention, there is provided a drive circuit for an electroluminescence display device. In the device, each of a plurality of pixels comprises an electroluminescence element including at least an emissive layer between an anode separately provided for each pixel and a cathode commonly provided for the plurality of pixels. Each pixel further comprises at least a switch element for controlling a current supply from a power source commonly provided for the plurality of pixels to the anodes of the electroluminescence element. The drive circuit includes a current detector circuit for detecting current flowing from the common cathode provided for the plurality of pixels, and a control circuit for controlling the emissive luminance of the electroluminescence elements according to the detected current.

In a still further aspect of the present invention, the current detector circuit generates a voltage corresponding to the detected current. Furthermore, the control circuit includes a voltage inverting amplifier circuit for inverting and amplifying a voltage output from the current detector circuit, and a current amplifier circuit for performing current amplification of an output from the voltage inverting amplifier circuit.

According to another aspect of the present invention, there is provided a method for driving an electroluminescence display device having a plurality of pixels. Each pixel comprises an electroluminescence element including at least an emissive layer between an anode separately provided for each pixel and a cathode commonly provided for the plurality of pixels. Each pixel further comprises at least a switch element for controlling a current supply from a power source commonly provided for the plurality of pixels to the anodes of the electroluminescence elements. The driving method comprises the step of detecting a current flowing from the common cathode provided for the plurality of pixels, and the step of controlling emissive luminance of the electroluminescence elements according to the detected current.

When a common cathode is provided for a plurality of pixels as described above, the amount of current flowing from the cathode increases along with the increase of the number of pixels emitting light in the display panel. When a greater number of display screen pixels emit light, the luminance of the overall screen increases, possibly causing problems such as loss of optimal luminance for the display image and increased power consumption. By controlling the emissive luminance of the electroluminescence elements according to the amount of current flowing from the cathode, images can be displayed at its optimal luminance in accordance with the number of light-emitting pixels. At the same time, wasteful increase of power consumption can be prevented. When the number of light-emitting pixels is less, the amount of current flowing into the cathode decreases. In response to this decrease, the emissive luminance of the electroluminescence elements can be increased, thereby preventing, when fewer pixels emit light, the overall display screen from appearing too dark in comparison with when many light-emitting pixels exist. In this way, favorable display images having optimal contrast and luminance can be consistently displayed regardless of the number of pixels emitting light.

According to a still further aspect of the present invention, in controlling the emissive luminance of the electroluminescence elements, the voltage of the power source is lowered when the detected current increases, while the voltage of the power source is increased when the detected current decreases.

By employing such a manner of control, the luminance of each electroluminescence element can be easily and reliably controlled.

DESCRIPTION OF THE PREFERRED EMBODIMENT

Figure 1:
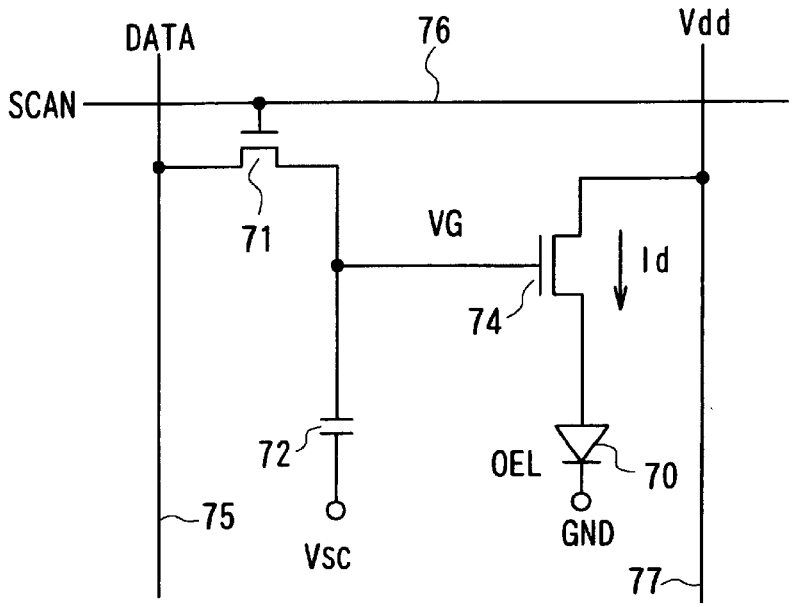
Fig. 1 PRIOR ART
FIG. 1 is a diagram showing a circuit configuration of a conventional EL display device.
Figure 2:
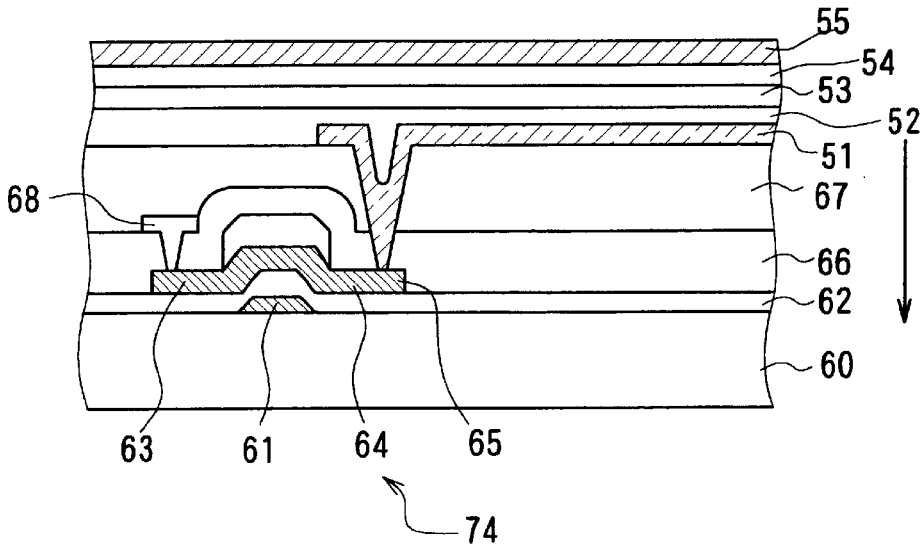
Fig. 2 PRIOR ART
FIG. 2 is a cross-sectional view illustrating the structure of a conventional EL display device.
Figure 3:
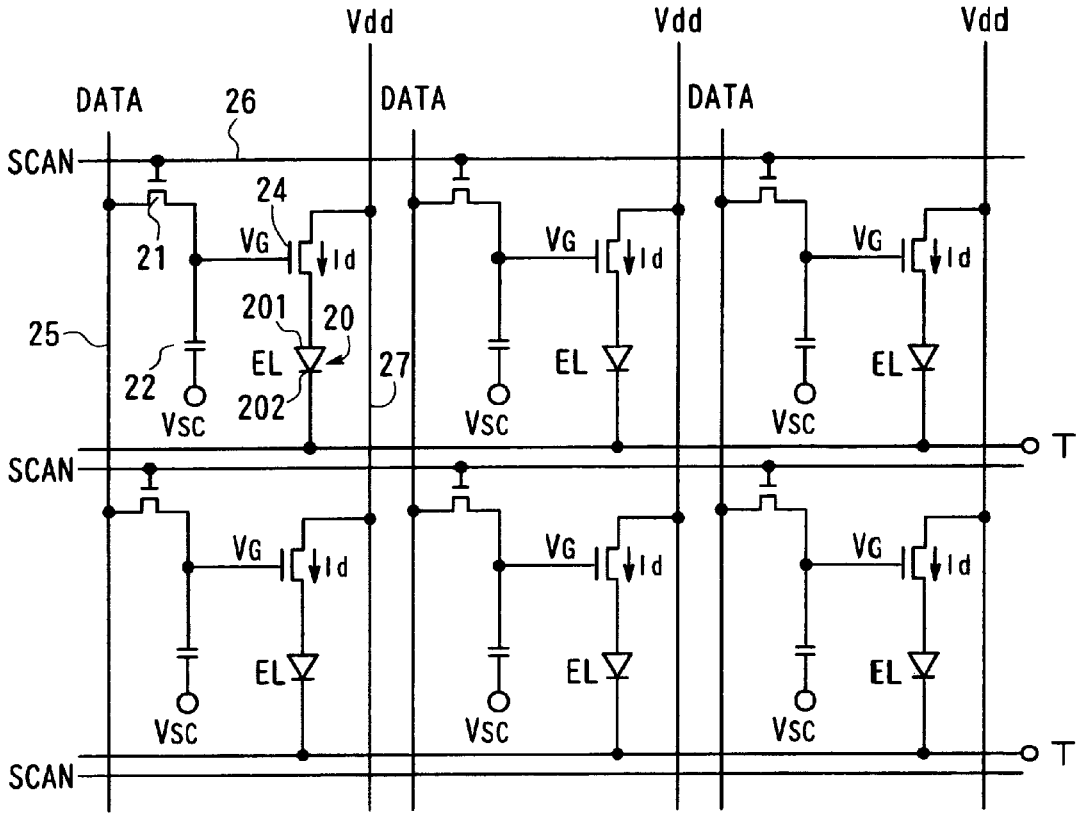
FIG. 3 is a diagram showing a circuit configuration of an EL display panel according to an embodiment of the present invention.

FIG. 3 shows a circuit configuration of an EL display panel used in an EL display device according to the present invention. The configuration is basically similar to the conventional arrangement.

Specifically, the present structure relates to an active type including a plurality of pixels. A drive circuit for driving an organic EL element 20 in one pixel comprises a switching TFT 21 which turns on and off according to a selection signal SCAN. In the TFT 21, a display signal DATA from a display signal line 25 is applied to the drain, while the selection signal SCAN from a selection signal line 26 is applied to the gate. The drive circuit also comprises a capacitor 22 connecting the source of the TFT 21 and a predetermined direct current (DC) voltage Vsc. When the TFT 21 is turned on, the capacitor 22 is charged with the display signal. The capacitor 22 retains the charge voltage VG when the TFT 21 is turned off. The drive circuit further includes a driving TFT 24. In the TFT 24, the drain is connected to a power source line 27 that supplies a power source voltage Vdd, while the source is connected to the anode 201 of the organic EL element 20. The retained voltage VG from the capacitor 22 is supplied to the gate of the TFT 24, which allows the TFT 24 to drive the organic EL element 20 by a current.

Figure 6:
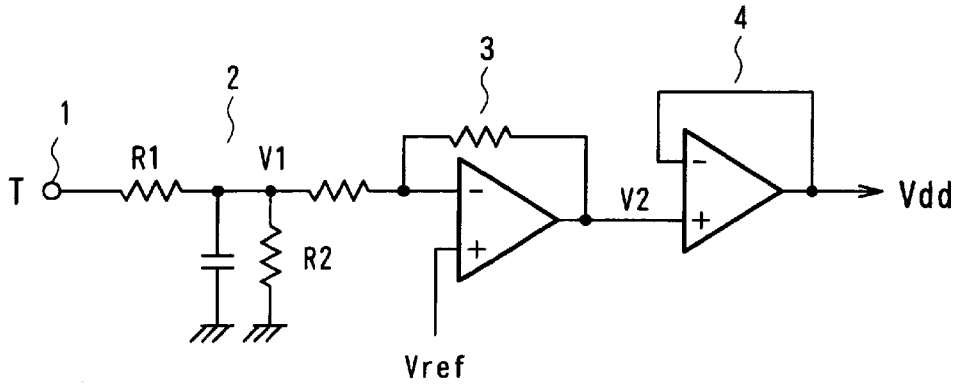
FIG. 6 is a diagram showing a configuration of the drive circuit according to the embodiment of the present invention.

As in a conventional configuration, the cathode 202 of the organic EL element 20 is connected to a terminal T which supplies a fixed potential such as the ground (GND) potential. The voltage Vsc may be a positive potential such as 10V or, alternatively, the ground potential. Differing from a conventional configuration as described above, the power source voltage line 27 of the present embodiment is not supplied with a fixed positive potential such as 10V, but is rather provided with a variable power source voltage Vdd by an external circuit as shown in FIG. 6 explained below.

Figure 4:
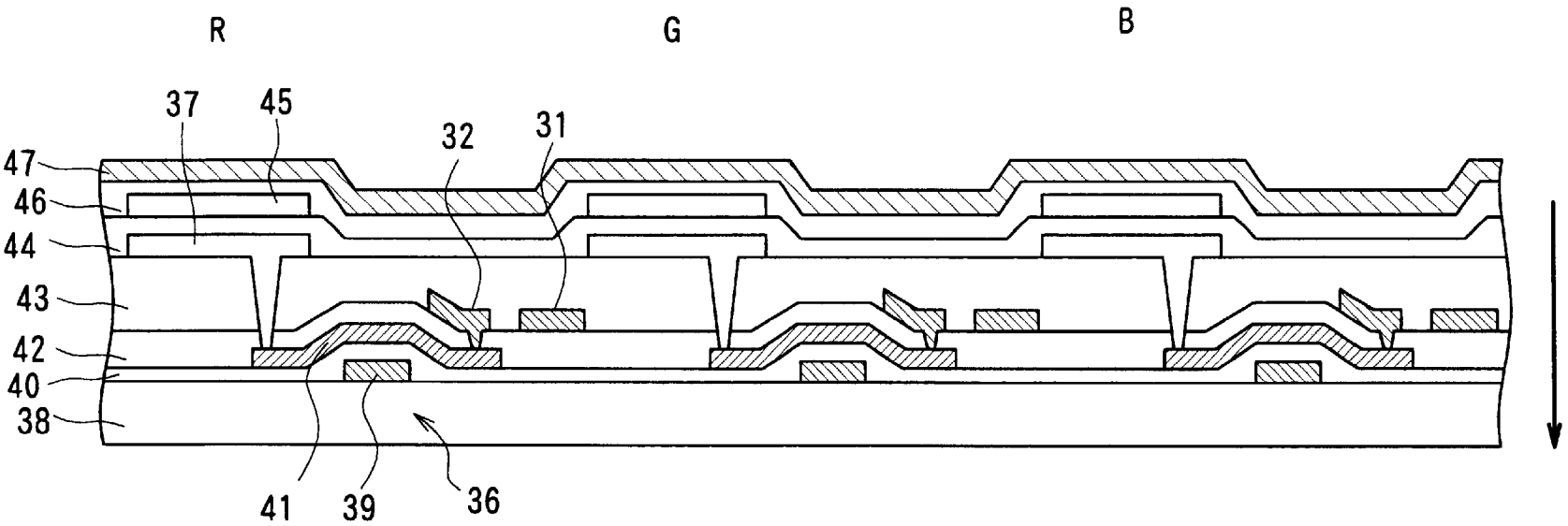
FIG. 4 is a diagram showing a schematic cross-sectional configuration of organic EL elements and TFTs for driving the elements in the EL display panel according to the embodiment of the present invention.

FIG. 4 is a cross-sectional view of a plurality of pixels illustrating the structure of the EL elements 20 and driving TFTs 24 shown in FIG. 3. Numeral 31 denotes the drain line made of aluminum for supplying the display signal DATA to the TFT 21. 32 is the power source voltage line made of aluminum for supplying power source voltage Vdd. 36 indicates the driving TFT 24 of FIG. 3. 37 denotes the anode 201 of the EL element 20. The anode 201 is composed of ITO, and constitutes the pixel electrode.

The driving TFT 36 is formed as follows. A gate electrode 39 made of chromium is first formed on a transparent glass substrate 38. A gate insulating film 40 is subsequently deposited. A poly-silicon thin film 41 is then formed on the gate insulating film 40. Covering the poly-silicon thin film 41, an interlayer insulating film 42 is disposed. Further on top, the drain line 31 and the power source line 32 are formed. After laminating a planarization insulating film 43, the anode 37 composed of ITO is subsequently formed. The drain region of the poly-silicon thin film 41 is contacted with the power source line 32, while the source region is contacted with the anode 37. The structure of the switching TFT 21 shown in FIG. 3 is identical with the driving TFT 36. The capacitor 22 connected to the TFT 21 is composed of a chromium electrode, a poly-silicon thin film which simultaneously serves as the active layer of the TFT 21, and the gate insulating film interposed between the chromium electrode and the poly-silicon thin film.

An anode 37 is separately formed for each pixel on the planarization insulating film 43. Sequentially laminated on each anode 37 are a hole-transport layer 44, an emissive layer 45, an electron transport layer 46, and a cathode 47, thereby forming an EL element. Light is emitted when a hole injected from the anode 37 and an electron injected from the cathode 47 recombine within the emissive layer 45. The light radiates out through the side of the transparent anode 37, as indicated by an arrow in the figure. The emissive layer 45 is separately formed for each pixel in a shape approximately identical with the anode 37. By using a different emissive material for each colors of RGB, lights of RGB are emitted from the respective EL elements.

The materials used for the hole transport layer 44, the electron transport layer 46, and the cathode 47 may be, for example, MTDATA, Alq3, and Mg-In alloy, respectively. The emissive layers 45 for each of R, G, and B may be composed using, respectively, Alq including DCM (4-(dicyanomethylene)-2-methyl-6-( 4-dimethylaminostyryl)-4H-pyran) class dopant, Alq including quinacridone as a dopant, and DPVBi (1,4-bis(2,2-diphenyl-vinyl) biphenyl) class material including distyrylarylene class dopant.

Figure 5:
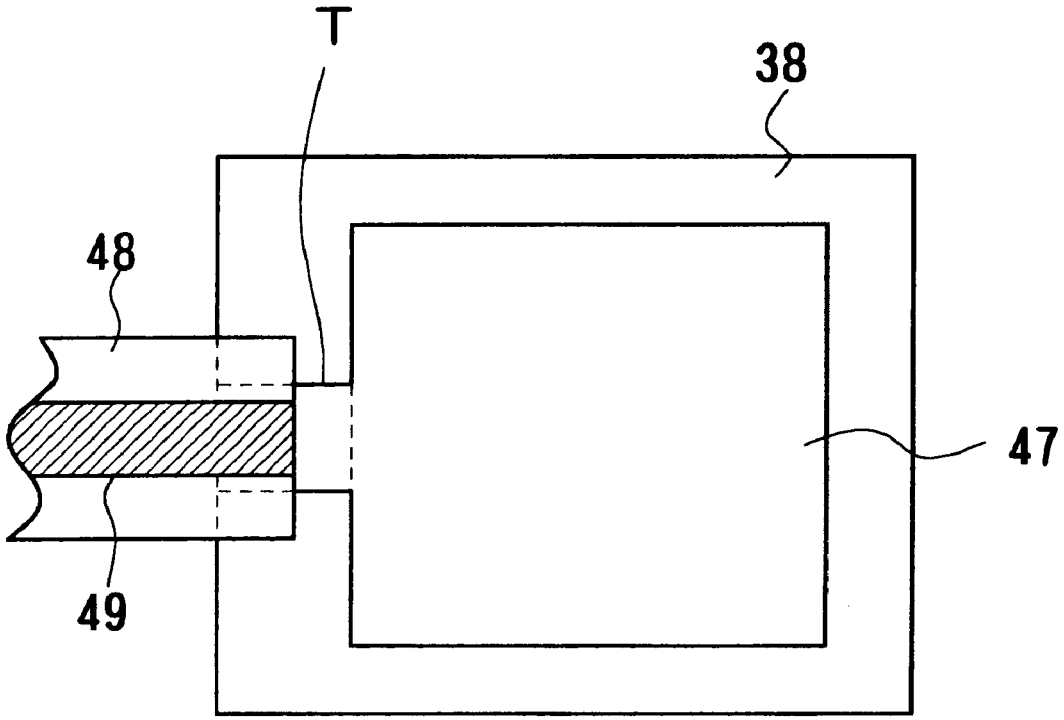
FIG. 5 is a diagram showing a schematic plan structure of the EL display panel according to the embodiment of the present invention.

In contrast to the anodes 37 of EL elements discretely formed for each pixel as described above, the cathode 47 is formed in common for all pixels as shown in FIG. 4. As further clearly shown in the plan view of FIG. 5, the cathode 47 is continuously formed over an extensive area of the surface. Furthermore, the cathode material is extended to form the connection terminal T that connects to the external circuit. The connection terminal T is linked to one of the connection terminals 49 composed of copper or a similar material on the bottom side of a signal substrate 48 such as TAB and FPC. The cathode 202 of the EL element 20 is connected to a fixed potential such as the ground (GND) potential. The connection terminals 49 on the input signal substrate 48 also include a connection terminal for the power source voltage. Via this connection terminal, the power source voltage Vdd is supplied from the external circuit shown in FIG. 6 to the power source line 27 of the EL display panel.

The external circuit connected via the input/output signal substrate 48 is next explained referring to FIG. 6.

In FIG. 6, numeral 1 denotes an input terminal connected to terminal T, for inputting to the circuit the current flowing from (into) the common cathode 202 for all EL elements 20. 2 is a current detector circuit including two resistors R1,R2 and a capacitor. The current detector circuit 2 detects the current flowing into the cathode, and outputs voltage V1 corresponding to the detected current. 3 indicates a voltage inverting amplifier circuit composed of two resistors and an operational amplifier. The voltage inverting amplifier circuit 3 performs inversion and voltage amplification of the output voltage V1. A current amplifier circuit 4 comprising an operational amplifier performs current amplification for providing a sufficient drive current for the EL elements 20. The output voltage from the current amplifier circuit 4 is supplied as the power source voltage Vdd to the power source line 27 shown in FIG. 3.

Figure 7A:
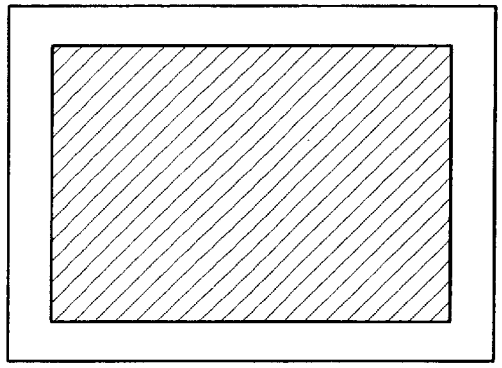
FIGS. 7A and 7B are diagrams illustrating the states of light emission of the EL display panel according to the embodiment of the present invention.

When a large number of pixels emit light and, accordingly, the light-emitting area (the portion indicated by slanted lines) dominates much of the display screen as shown in FIG. 7A, the current flowing from the cathode 202 common for all pixels increases. The current detector circuit 2 generates the output voltage V1 by resistively dividing an input voltage using R1 and R2. When more current flows into the cathode 202, the amount of current supplied from the common connection terminal T of the cathode 202 via the input terminal 1 to the current detector circuit 2 also increases, which in turn increases the resistively-divided voltage V1. As the subsequent voltage inverting amplifier circuit 3 inverts and amplifies the output voltage V1 obtained in the previous step, the output voltage V2 is, in contrast, lowered. The subsequent current amplifier circuit 4 amplifies the current of V2, and this output is supplied to the power source line 27.

In this way, when displaying an image in which many pixels emit light and, accordingly, the light-emitting area dominates much of the display screen as shown in FIG. 7A, the power source voltage Vdd is lowered. When the power source voltage Vdd for the TFTs 24 driving the EL elements 20 is lowered, the amount of current flowing in the EL elements 20 is consequently decreased, reducing the emissive luminance of the EL elements 20. The resulting decreased contrast is not very noticeable because the area covered by light-emitting pixels is large. Rather, the reduced luminance allows the display image to be less glaring and favorable to the eyes. Furthermore, power consumption can be suppressed.

Figure 7B:
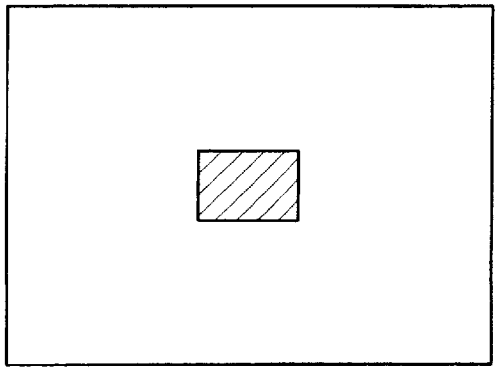

On the other hand, when only a small number of pixels emit light, i.e., when an image having a small light-emitting area within the display screen is displayed as shown in FIG. 7B, the current flowing into the common cathode 202 for all pixels decreases, lowering the resistively-divided voltage V1 generated by the current detector circuit 2. Consequently, in contrast, the output voltage V2 of the voltage inverting amplifier circuit 3 is increased. The power source voltage Vdd therefore increases, allowing more current to flow in the EL elements 20 and thereby increasing the emissive luminance of the EL elements 20. As a result, higher contrast is achieved to create a clear display image even when the area covered by light-emitting pixels is small. In this case, although the luminance is increased, power consumption is maintained at a low level because the number of light-emitting pixels is reduced.

The present embodiment is further explained below using specific numeric values as an example.

In this example, the total number of pixels is 100,000. Using the present invention, the total current consumption by all EL elements is set at 100 mA to provide a specific example.

When all pixels emit light, the amount of current flowing into the cathode increases, and the external circuit shown in FIG. 6 operates to reduce the power source voltage Vdd. As a result, the current consumption per pixel is suppressed to 100 mA/100,000=1 $\mu$A. The emissive luminance of each pixel is thereby decreased, producing non-glaring display and reducing power consumption. On the other hand, when only 100 pixels emit light among all pixels, the amount of current flowing into the cathode decreases, and the external circuit shown in FIG. 6 operates to increase the power source voltage Vdd. As a result, the current flowing in one pixel is augmented to 100 mA/100=1 mA. Accordingly, an image having high contrast can be displayed.

What is claimed is:

1. An electroluminescence display device having a plurality of pixels, wherein:

each pixel comprises an electroluminescence element including at least an emissive layer between an anode separately provided for each pixel and a cathode commonly provided for the plurality of pixels, and at least a switch element for controlling a current supply from a power source commonly provided for the plurality of pixels to the anodes of said electroluminescence elements; and a current flowing from said common cathode provided for the plurality of pixels is detected, and emissive luminance of said electroluminescence elements is controlled according to the detected current.

2. The device defined in claim 1, further comprising:

a current detector circuit for detecting current flowing from said common cathode provided for the plurality of pixels; and a control circuit for controlling the emissive luminance of said electroluminescence elements according to the detected current.

3. The device defined in claim 2, wherein said control circuit lowers the voltage of said power source when said detected current increases, and increases said power source voltage when said detected current decreases.

4. The device defined in claim 2, wherein said current detector circuit generates a voltage corresponding to said detected current; and said control circuit includes:

a voltage inverting amplifier circuit for inverting and amplifying a voltage output from said current detector circuit; and a current amplifier circuit for performing current amplification of an output from said voltage inverting amplifier circuit.

5. A drive circuit for an electroluminescence display device, each of a plurality of pixels in said device having an electroluminescence element including at least an emissive layer between an anode separately provided for each pixel and a cathode commonly provided for the plurality of pixels, and at least a switch element for controlling a current supply from a power source commonly provided for the plurality of pixels to the anodes of said electroluminescence elements, said drive circuit comprising:

a current detector circuit for detecting current flowing from said common cathode provided for the plurality of pixels; and a control circuit for controlling emissive luminance of said electroluminescence elements according to said detected current.

6. The drive circuit defined in claim 5, wherein said control circuit lowers the voltage of said power source when said detected current increases, and increases said power source voltage when said detected current decreases.

7. The drive circuit defined in claim 5, wherein said current detector circuit generates a voltage corresponding to said detected current; and said control circuit includes:

a voltage inverting amplifier circuit for inverting and amplifying a voltage output from said current detector circuit; and a current amplifier circuit for performing current amplification of an output from said voltage inverting amplifier circuit.

8. A method for driving an electroluminescence display device having a plurality of pixels, each pixel having an electroluminescence element including at least an emissive layer between an anode separately provided for each pixel and a cathode commonly provided for the plurality of pixels, and at least a switch element for controlling a current supply from a power source commonly provided for the plurality of pixels to the anodes of said electroluminescence elements, said driving method comprising the steps of:

detecting a current flowing from said common cathode provided for the plurality of pixels, and controlling emissive luminance of said electroluminescence elements according to said detected current.

9. The driving method defined in claim 8, further comprising the steps of:

lowering the voltage of said power source when said detected current increases; and increasing said power source voltage when said detected current decreases.

* * * * *